United States Patent [19]

Iosso

[11] 4,095,014

[45] June 13, 1978

[54] WEAR-RESISTANT ZINC ARTICLES

[76] Inventor: Richard C. Iosso, 301 South Lancaster Ave., Mt. Prospect, Ill. 60056

[21] Appl. No.: 702,533

[22] Filed: Jul. 6, 1976

[51] Int. Cl.[2] ..... B32B 15/00

[52] U.S. Cl. ..... 428/658; 204/51; 428/666

[58] Field of Search ..... 29/194, 196.5; 204/51, 204/81; 428/610, 658, 666

[56] References Cited

U.S. PATENT DOCUMENTS

| | | | |
|---|---|---|---|
| 2,234,189 | 3/1941 | Murray | 29/194 X |
| 2,855,348 | 10/1958 | Topelian | 204/51 X |
| 3,661,733 | 5/1972 | Roggendorf | 204/51 |
| 3,816,082 | 6/1974 | Austin et al. | 29/196.5 X |
| 3,954,574 | 5/1976 | Gyllenspetz et al. | 204/51 |

*Primary Examiner*—Arthur J. Steiner
*Attorney, Agent, or Firm*—Dressler, Goldsmith, Clement, Gordon & Shore, Ltd.

[57] ABSTRACT

A wear-resistant article comprises a zinc base metal having a substantially continuous, hard chromium skin layer on at least one surface thereof and a chromium-enriched subsurface layer of the zinc base metal situated immediately below the chromium skin layer. The chromium-enriched subsurface layer has a gradually decreasing chromium content in a direction inwardly away from the skin layer and is at least as thick as the skin layer. The wear-resistant article of this invention is produced by direct electrodeposition of chromium onto the zinc base metal from a self-regulating bath under controlled conditions.

2 Claims, 1 Drawing Figure

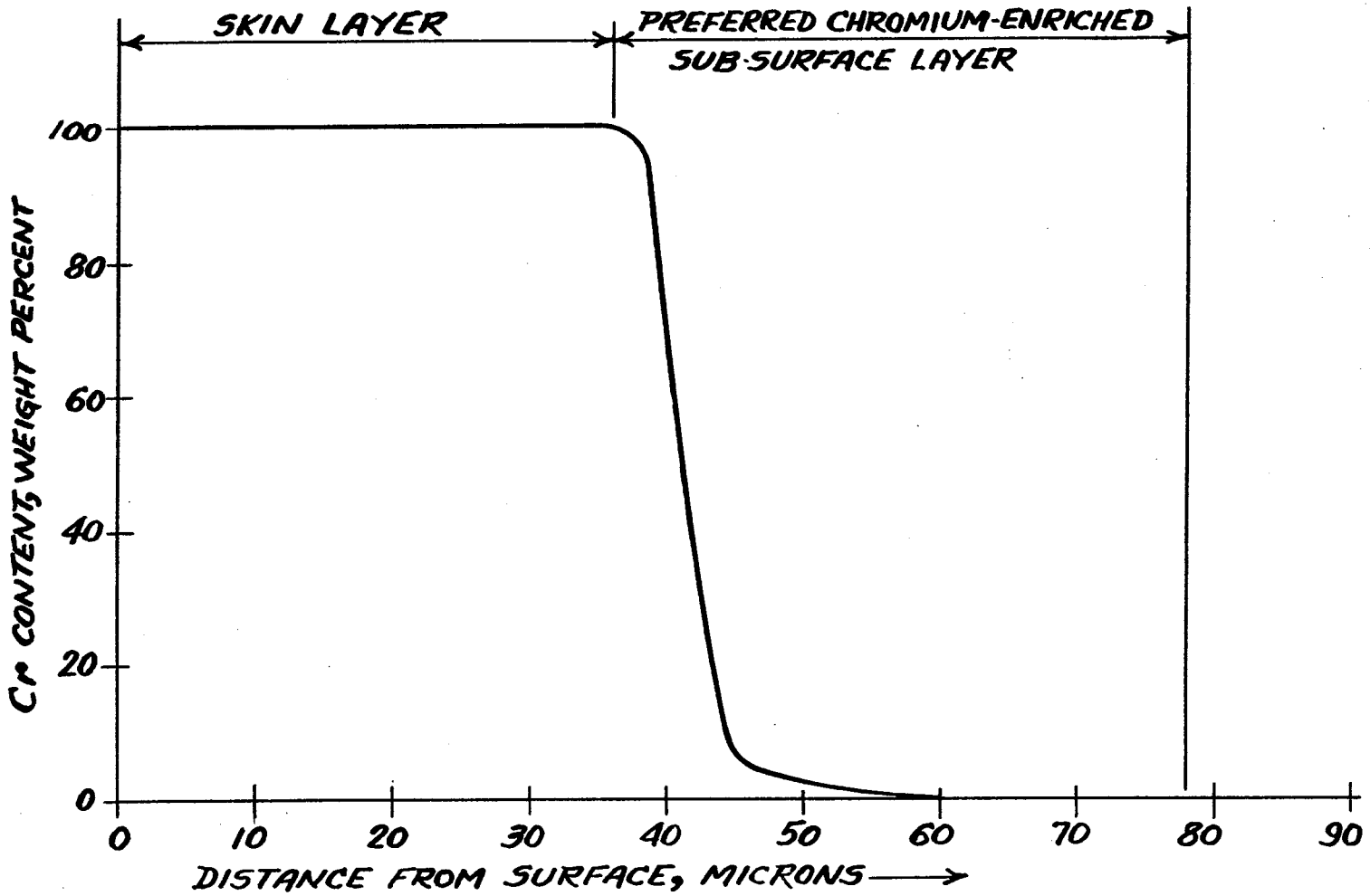
SKIN LAYER
PREFERRED CHROMIUM-ENRICHED
SUB-SURFACE LAYER
Cr CONTENT, WEIGHT PERCENT
100
80
60
40
20
0
0
10
20
30
40
50
60
70
80
90
DISTANCE FROM SURFACE, MICRONS

WEAR-RESISTANT ZINC ARTICLES

BACKGROUND OF THE INVENTION

This invention relates to the electrodeposition of chromium onto zinc or zinc alloys.

A great number of articles, such as machine parts, are fabricated from zinc base metal compositions such as zinc and zinc alloy die castings. Such articles usually are provided with surface finishes which inhibit, reduce, or eliminate corrosion associated with outdoor exposure. A commonly utilized surface finish for these purposes is a composite coating of copper, nickel, and chromium which is applied by first polishing, degreasing and cleaning the surface of the article and thereafter sequentially electrodepositing thereon layers of copper, nickel, and chromium. However, upon prolonged exposure to the elements the electrodeposited surface finishes begin to blister and peel off.

Die casting of zinc base metal is an extremely versatile method of fabricating complex metal shapes with close dimensional tolerances and at a relatively low cost. Hoever, because of susceptibility to corrosion, a protective coating is usually required. Typical such protective coatings are applied by electrodeposition by first applying a copper strike, and then one or more coating of nickel followed by a coating of chromium. While die cast parts produced from zinc base metals provide the basic advantages of cost and weight, corrosion nevertheless is a problem even with the protective coatings. Besides, the wear resistance of such parts is notoriously inadequate for applications involving friction contact between moving surfaces.

The usual commercial chromium plating electrolytes utilized for protective coatings consist of aqueous chromic anhydride ($CrO_3$) solutions, also commonly referred to as chromic acid solutions, which contain certain catalysts which enable the chromium contained in the solution to be electrodeposited. These catalysts usually are sulfate ($SO_4^=$) and silicofluoride or fluosilicate ($SiF_6^=$) ions. In order to optimize the chromium electrodeposition conditions these catalysts must be present in certain specific relative amounts based on the concentration of chromic acid present in the electrodeposition bath. In the so-called self-regulating electrodeposition baths concentrations of the cooperating catalyst ions are controlled automatically by means of the solubility characteristics of the compounds that are used to supply these ions to the bath solution. Illustrative self-regulating chromium electrodeposition baths are disclosed in U.S. Pat. No. 2,640,022 to Stareck and in U.S. Pat. No. 2,686,756 to Stareck et al.

The articles of the present invention, however, while fabricated from zinc base metals cast in the usual manner, are provided with a generally bright, hard chromium skin which has good adhesion to the base metal and which exhibits excellent wear resistance as well as corrosion resistance.

SUMMARY OF THE INVENTION

The present invention contemplates articles of manufacture made from a zinc base metal and having a substantially continuous, wear-resistant hard chromium skin layer on at least one surface thereof. Immediately adjacent and below the skin layer is provided a chromium-enriched subsurface layer of the zinc base metal which is at least as thick as the chromium skin layer and in which the chromium content decreases gradually in a direction inwardly away from the skin layer.

An electrodeposition bath suitable for the production of the aforesaid novel article of manufacture comprises an aqueous chromic acid solution containing sulfate ions in an amount so that the weight ratio of chromic acid to the sulfate ions is about 75:1 to about 125:1, respectively, and further containing an alkali metal fluosilicte in an amount of about 0.1 to about 0.3 ounces per gallon of the solution, boric acid in an amount of about 0.015 to about 0.05 ounces per gallon of the solution, and an alkali metal carbonate in an amount of about 0.01 to about 0.03 ounces per gallon of said solution. A trace amount of a halide ion such as chloride or fluoride can also be present.

To provide a fabricated zinc base metal article with the wear-resistant skin and the chromium-enriched subsurface layer, the fabricated article is precleaned and then immersed in the electrodeposition bath and connected into the electrodeposition circuit as the cathode thereof. Electrodeposition is carried out by passing direct current from a submerged anode to the cathode through the bath and is commenced with an initial strike of relatively short duration (less than about one minute) at an elevated voltage of about 7.5V to about 12.5V. Thereafter chromium from the bath is deposited on the cathode at a relatively lower voltage (at least about 20 percent lower than strike voltage) for a time period of about one minute to about 45 minutes. Chromium electrodeposition takes place at a relatively high current density and at a relatively low bath temperature. the electrodeposition bath temperature can vary from about 90° F. to about 135° F., and preferably is in the range of about 100° F. to about 130° F. The cathode current density is at least about 3.5 amperes per square inch and preferably about 4 to about 5 amperes per square inch. The preferred cathode current density varies to some extent with the configuration of the workpiece, the bath temperature and, at a given current efficiency, generally increases with increasing bath temperature.

As used herein and in the appended claims, by the expression "zinc base metal" is meant zinc or a zinc alloy normally used for the manufacture of die cast parts and containing varying amounts of aluminum, magnesium, copper and similar alloying elements.

BRIEF DESCRIPTION OF THE DRAWING

In the drawing, the sole FIGURE is a graph showing the chromium concentration of the skin layer and the chromium-enriched subsurface layer as a function of distance from the surface of a typical article fabricated from a zinc base metal and embodying the present invention.

DESCRIPTION OF PREFERRED EMBODIMENTS

The electrodeposition bath for practicing the present invention contains about 28 to about 35 ounces of chromic acid per gallon, sulfate ions and other catalysts, and preferably is prepared using deionized water. For continuous electrodeposition the weight ratio of chromic acid ($CrO_3$) to the sulfate ions present in the bath preferably is about 100:1; however, the weight ratio can vary from about 75:1 to about 125:1. The usual source of the sulfate ions is sulfuric acid or sodium sulfate, but it is not important with what particular substance the sulfate ions are combined when entering the bath as long as the sulfate ions become available in the desired concentration upon dissolution of the introduced substance. It should be recognized, however, that some sulfate is likely to be present as an impurity in commercial grades of chromic acid and allowance should be made for sulfate ions that have been introducted into the bath in such a manner. The self-regulating character of the electrodeposition bath is provided by the additionn of fluosilicate ($SiF_6^=$) ions, usually in the form of an alkali metal fluosilicate, i.e., $K_2SiF_6$ or $Na_2SiF_6$, and by controlling the solubility characteristics of the sulfates and fluosilicates in the bath by utilizing the so-called common-ion effect. The concentration of dissolved sulfate ions in the bath varies in accordance with the desired ration of $CrO_3/SO_4^{-2}$, and that of the dissolved fluosilicate from about 0.1 to about 0.3 ounces per gallon. The solubility of the sulfate and fluosilicate ions at the desired chromic acid concentrations, i.e., about 28 to about 35 oz./gallon, so as to povide a bath substantially saturated with respect to the sulfate ions and the fluosilicate ions, is controlled by the addition of an alkali metal carbonate, preferably together with an alkali metal bicarbonate. The relative amounts of carbonate and bicarbonte may vary; however, preferably the weight ratio of carbonate-to-bicarbonate is about 0.6:1 to about 1.3:1, respectively. Most preferably, to provide the common ion effect, if the sulfate source was sodium sulfate, sodium carbonate alone or admixed with sodium bicarbonate is added. Similarly, if the fluosilicate ion source was potassium fluosilicate, then the solubility thereof is controlled by the addition of potassium carbonate or mixtures of potassium carbonate with potassium bicarbonate.

Boric acid is added to the electrodeposition bath to enhance current efficiency and may also serve as a brightening agent for the chromium deposit. Boric acid is usually present in the bath in an amount of about 0.015 to about 0.05 ounces per gallon. Inasmuch as the throwing power of the bath is reduced by the presence of boric acid, preferably a relatively low concentration of boric acid is maintained in the bath.

It has been found that a beneficial effect obtains by the addition of a small amount of an alkali metal halide, for example, sodium or potassium chloride or fluoride, to provide a trace amount of halide ion in the bath. Preferably, the halide ion concentration in the bath is about 1 to about 100 parts per million. If no bicarbonate is present in the bath, the halide ion concentration preferably is increased by about a factor of 2.

To maintain the proper catalyst and additive balance in the bath, it is expedient to prepare a dry chemical composition which can be introduced into the aqueous chromium electrodeposition bath in a predetermined amount. An illustrative composition is shown in Table I, below.

Table I

| Dry Chemical Composition | |
|---|---|
| Ingredient | Parts by Weight |
| $Na_2SiF_6$ | 37 |
| $H_3BO_3$ | 22.2 |
| $Na_2CO_3$ | 22.2 |
| $NaHCO_3$ | 18.5 |
| NaCl | trace |

The present chromium electrodeposition bath can be used for direct electrodeposition of hard chromium onto an article made from a zinc base metal so as to improve the wear resistance, surface hardness, and corrosion resistance thereof. As pointed out hereinabove, by the term "zinc base metal" is meant zinc or a zinc alloy of the type normally used for die casting. Illustrative of such alloys is ASTM Alloy AG 40A (SAE Alloy 903) made with special high grade zinc alloyed with about 4 weight percent aluminum, 0.04 weight percent magnesium, a maximum 0.25 weight percent copper, less than 0.1 weight percent iron, less than 0.005 weight percent lead, less than 0.004 weight percent cadmium, and less than 0.003 weight percent tin. Another typical alloy is ASTM Alloy AC 41A (SAE 925) which is similar in composition to ASTM AG 40A but has a higher copper content, i.e., 0.75 to about 1.25 weight percent copper.

Yet another suitable alloy comprises about 95 weight percent zinc, about 1.25 weight percent copper, about 3.5 weight percent aluminum, about 0.1 weight percent iron, about 0.02 weight percent magnesium, about 0.005 weight percent lead, about 0.004 weight percent cadmium, and about 0.003 weight percent tin.

Prior to the direct electrodeposition of chromium thereon the surface of the fabricated zinc base metal article must be smoothed and precleaned so as to removed grease and oil, zinc oxides and hydroxides, and other undesirable substances. Smoothing can be accomplished by mechanical means such as mechanical polishing with abrasive-coated wheels or belts, by tumbling with abrasive media, or by vibratory finishing with appropriate abrasive media.

The smoothed, fabricated article can be precleaned using a grease and oil solvent such as trichloroethylene, perchloroethylene, or the like, alkaline washed with a power spray, emulsion cleaned in agitated emulsions of soaps, kerosene, or other hydrocarbons and water to remove nonsaponifiable oil and grease if present, or alkaline soak cleaned with a solution containing sodium tripolyphosphate and one or more surfactants.

After precleaning the article can also be subjected to an electrocleaning step, usually by anodic cleaning in a solution containing mixed alkalis such as sodium tripolyphosphate and sodium metasilicate, surfactants, and a small amount of sodium hydroxide. A water rinse is usually performed between the various cleaning operations.

After alkaline cleaning and electrocleaning operations the article is immersed into an acid dip to remove any zinc oxides or hydroxides that may be present and also to neutralize any alkaline compounds that may have been carried over from the electrocleaning operation.

During the actual electrodeposition step the fabricated article is cathodic and, immediately after immersion in the chromium electrodeposition bath, is subjected to an initial strike at an elevated voltage of about 7.5V to about 12.5V, for a time period of less than about one minute and preferably for about 10 to about 45 seconds. Thereafter the electrodeposition voltage is reduced to a value at least about 20 percent less than the strike voltage, preferably to about 4V to about 9V, and the deposition of chromium continued at an average, substantially constant current density of at least about 3.5 amperes per square inch, preferably about 4 to about 5 amperes per square inch, until the desired thickness of skin layer is obtained. For a generally shiny, hard chromium deposit having a thickness of about 20 to about 30 microns the required electrodeposition time period is about 10 minutes to about 20 minutes. At the same time, chromium is driven also into the sublayer and increases the hardness thereof.

Bath temperature and current density are interrelated to some extent. In practicing the present invention the foregoing current densities are maintained at bath temperatures of about 90° F. to about 135° F. The bath temperature should not exceed about 135° F., however, because at higher bath temperatures the quality of the deposite suffers and the throwing power of the bath also decreases. For optimum results a bath temperature of about 100° F. to about 130° F. is preferred. Bath temperatures below about 80° F. generally are not desirable because the chromium deposited at such temperatures appears to have a different, less desirable crystalline form.

Anode composition is not overly critical for the purposes of the present invention. Conventional lead-tin alloy electrodes can be utilized. The anode configuration is determined by the cathodic surface of the workpiece on which chromium is to be deposited.

As an illustrative example, a die cast zinc alloy machine part, fabricated from a zinc base metal containing zinc (about 95 wt.-%), copper (about 1.25 wt.-%), aluminum (about 3.5 wt.-%), iron (about 0.1 wt.-%), magnesium (about 0.2 wt.-%), cadmium (about 0.004 wt.-%), lead (about 0.005 wt.-%), and tin (about 0.003 wt.-%) is appropriately cleaned and rinsed and then immersed into an aqueous chromium electrodeposition bath solution containing about 28 oz./gal. $CrO_3$, about 0.28 oz./gal. total $SO_4^{-2}$ and $SiF_6^{-2}$, about 0.3 oz./gal. boric acid, about 0.014 oz./gal. sodium carbonate, about 0.011 oz./gal. sodium bicarbonate, and a trace amount of sodium chloride.

A relatively low current is passed through the bath as soon as the machine part becomes immersed in the bath solution and then the part is subjected to a 15-second strike at about 9V. Thereafter, electrodeposition of chromium is continued for about 5 minutes at about 5V and at an average current density of about 4.5 amperes per square inch. During electrodeposition, the bath solution temperature is about 130° F. and the bath pH about 0.5 to 1.5. After the direct electrodeposition of chromium is terminated, a substantially pure chromium skin layer about 36 microns thick is obtained. The obtained chromium surface exhibits exceptional hardness (a Rockwell C hardness value of about 64) and wear resistance.

A sepcimen of a zinc alloy machine part produced in the aforedescribed manner was analyzed with an electron microprobe at 20 KV for chromium content. The obtained data are present in Table II hereinbelow.

Table II

Electron Microprobe Analysis

Conditions: 20 KV; 5 nanoamperes (NA) on Zn

| Time (seconds) | Distance From Surface (microns) | Specimen Current (NA) | X-Ray Count Cr | X-Ray Count Zn | Cr (wt. - %) | Zn (wt. - %) |
|---|---|---|---|---|---|---|
| 010.000 | 3 | 00005.02 | 0034998 | 0000059 | 100.0 | 0.0 |
| 010.000 | 6 | 00005.04 | 0034701 | 0000134 | | |
| 010.000 | 9 | 00005.03 | 0035074 | 0000069 | | |
| 010.000 | 12 | 00005.04 | 0035157 | 0000070 | | |
| 010.000 | 15 | 00005.04 | 0034868 | 0000062 | | |
| 010.000 | 18 | 00005.03 | 0035093 | 0000060 | | |
| 010.000 | 21 | 00005.03 | 0035112 | 0000053 | | |
| 010.000 | 24 | 00005.02 | 0034855 | 0000059 | | |
| 010.000 | 27 | 00005.03 | 0035117 | 0000060 | | |
| 010.000 | 30 | 00005.02 | 0035244 | 0000055 | | |
| 010.000 | 33 | 00005.04 | 0034743 | 0000081 | | |
| 010.000 | 36 | 00005.00 | 0034920 | 0000064 | 100.0 | 0.0 |
| 010.000 | 39 | 00004.62 | 0030364 | 0001917 | 88.0 | |
| 010.000 | 42 | 00005.02 | 0004982 | 0014120 | 15.0 | |
| 010.000 | 45 | 00004.88 | 0001585 | 0015413 | 5.5 | |
| 010.000 | 48 | 00004.83 | 0001083 | 0015627 | 3.5 | |
| 010.000 | 51 | 00004.74 | 0000842 | 0015864 | 2.7 | |
| 010.000 | 54 | 00004.90 | 0000635 | 0015122 | | |
| 010.000 | 57 | 00004.77 | 0000499 | 0016296 | 1.4 | |
| 010.000 | 60 | 00004.82 | 0000420 | 0016213 | | |
| 010.000 | 63 | 00004.76 | 0000374 | 0017132 | | |
| 010.000 | 66 | 00004.80 | 0000302 | 0016854 | | |
| 010.000 | 69 | 00004.79 | 0000305 | 0017039 | 0.7 | |
| 010.000 | 72 | 00004.80 | 0000268 | 0016461 | | |
| 010.000 | 75 | 00004.81 | 0000222 | 0016429 | | |
| 010.000 | 78 | 00004.77 | 0000200 | 0016780 | 0.4 | |
| 010.000 | 81 | 00004.79 | 0000178 | 0016569 | | |
| 010.000 | 84 | 00004.77 | 0000182 | 0017062 | | |
| 010.000 | 87 | 00004.79 | 0000158 | 0016993 | | |
| 010.000 | 90 | 00004.81 | 0000158 | 0016462 | 0.2 | |
| 010.000 | 110 | 00004.88 | 0000164 | 0017228 | | |
| 010.000 | 130 | 00004.86 | 0000149 | 0017603 | | |
| 010.000 | 150 | 00004.89 | 0000136 | 0017036 | 0.1 | |
| 010.000 | 170 | 00004.94 | 0000113 | 0017135 | | |
| 010.000 | 190 | 00004.89 | 0000121 | 0017413 | | |
| 010.000 | 210 | 00004.88 | 0000104 | 0017188 | | |
| 010.000 | 230 | 00004.87 | 0000133 | 0017797 | | |
| 010.000 | 250 | 00004.90 | 0000110 | 0017428 | | |
| 010.000 | 270 | 00004.92 | 0000113 | 0017385 | | |
| 010.000 | 290 | 00004.84 | 0000111 | 0018371 | | |
| 010.000 | 310 | 00004.92 | 0000102 | 0017296 | | |
| 010.000 | 330 | 00004.91 | 0000118 | 0017548 | | |
| 010.000 | 350 | 00004.89 | 0000107 | 0017759 | | |
| 010.000 | 370 | 00004.87 | 0000099 | 0018422 | | |
| 010.000 | 390 | 00004.93 | 0000117 | 0017099 | | |
| 010.000 | 410 | 00004.92 | 0000104 | 0017422 | | |
| 010.000 | 430 | 00004.91 | 0000091 | 0017764 | | |
| 010.000 | 450 | 00004.92 | 0000108 | 0017833 | | |
| 010.000 | 470 | 00004.93 | 0000108 | 0017300 | | |
| 010.000 | 490 | 00004.97 | 0000130 | 0017013 | | |
| 010.000 | 510 | 00004.88 | 0000111 | 0018343 | | |
| 010.000 | 530 | 00004.93 | 0000112 | 0017215 | | |

Table II-continued

| Electron Microprobe Analysis | | | | | | |
|---|---|---|---|---|---|---|
| Conditions: 20 KV; 5 nanoamperes (NA) on Zn | | | | | | |
| Time (seconds) | Distance From Surface (microns) | Specimen Current (NA) | X-Ray Count Cr | X-Ray Count Zn | Cr (wt. - %) | Zn (wt. - %) |
| 010.000 | 550 | 00004.94 | 0000109 | 0017640 | | |

The foregoing data show that the produced skin layer is substantially pure chromium inwardly for a distance of about 36 microns and that there is present a significant chromium concentration in the immediately adjacent subsurface layer down to a depth of at least about 150 microns. The foregoing data is presented graphically in the accompanying FIGURE.

The hardness of fabricated zinc base metal articles processed in accordance with the present invention also has been investigated at various depths below the chromium-bearing surface thereof. The observed hardness values are set forth in Table III hereinbelow.

Table III

| | Hardness of Treated Castings | |
|---|---|---|
| | Depth from Surface (microns) | Hardness Vickers |
| Casting #1 (5 μ skin) | 0 | 409 |
| | 5 | 408 |
| | 14 | 57 |
| | 19.4 | 45 |
| | 20 | 41 |
| | 32.4 | 40 |
| | 45 | 37 |
| | 64 | 41 |
| Casting #2 (3.5 μ skin) | 0 | 795 |
| | 4 | 94 |
| | 10 | 60 |
| | 11.4 | 72 |
| | 33 | 52 |

In general, when practicing the present invention the chromium-enriched subsurface layer that is produced during electrodeposition is at least as thick as the chromium skin layer and usually is even thicker. This chromium-enriched layer is also harder than the zinc base metal casting itself and materially contributes to the wear resistance of the manufactured part. The chromium content of the enriched subsurface layer is at least about 0.1 percent by weight and preferably at least about 0.4 percent by weight.

The foregoing specification is intended to be illustrative and is not to be taken as limiting. Still other variations within the spirit and scope of this invention are possible and will readily present themselves to one skilled in the art.

I claim:

1. An article of manufacture which comprises a zinc base metal having a substantially continuous, wear-resistant chromium skin layer on at least one surface thereof and a chromium-enriched subsurface layer of said zinc base metal immediately below said chromium skin layer; said subsurface layer containing at least about 0.1 percent by weight chromium, having a gradually decreasing chromium content in a direction inwardly away from said skin layer, being at least as thick as said skin layer, and having a hardness greater than the hardness of said zinc base metal below said subsurface layer.

2. The article of manufacture in accordance with claim 1 wherein the chromium content of said subsurface layer is at least about 0.4 percent by weight.

* * * * *